United States Patent [19]

Lindsey, Jr.

[11] Patent Number: 4,926,938

[45] Date of Patent: May 22, 1990

[54] ROTATABLE LINER HANGER WITH MULTIPLE BEARINGS AND CONES

[75] Inventor: Hiram E. Lindsey, Jr., Midland, Tex.

[73] Assignee: Lindsey Completion Systems, Inc., Midland, Tex.

[21] Appl. No.: 351,734

[22] Filed: May 12, 1989

[51] Int. Cl.[5] ..... E21B 23/00

[52] U.S. Cl. ..... 166/208; 166/117.7; 166/212; 166/217; 166/286

[58] Field of Search ..... 166/208, 382, 286, 285, 166/212, 217, 177, 117.7

[56] References Cited

U.S. PATENT DOCUMENTS

| | | | |
|---|---|---|---|
| Re. 30,988 | 7/1982 | Crickmer | 166/217 |
| 1,606,402 | 11/1926 | Crowell . | |
| 2,053,065 | 9/1936 | Crowell . | |
| 2,431,751 | 12/1947 | Hayward . | |
| 2,616,503 | 11/1952 | Armentrout . | |
| 2,619,179 | 11/1952 | Armentrout . | |
| 2,631,670 | 3/1953 | Armentrout . | |
| 2,670,045 | 2/1954 | Armentrout . | |
| 2,876,844 | 3/1959 | Warner | 166/208 X |
| 3,195,646 | 7/1965 | Brown | 166/208 |
| 3,291,220 | 12/1966 | Mott | 166/208 |
| 3,314,478 | 4/1967 | Burns . | |
| 3,382,927 | 5/1968 | Davis, Jr. | 166/124 |
| 3,455,381 | 7/1969 | Page, Jr. | 166/121 |
| 3,460,617 | 8/1969 | Brown et al. | 166/124 |
| 3,720,261 | 3/1973 | Heilhecker et al. | 166/208 |
| 4,010,804 | 3/1977 | Garcia | 166/208 X |
| 4,033,640 | 7/1977 | Garcia | 308/4 A |
| 4,047,565 | 9/1977 | Crickmer | 166/217 |
| 4,190,300 | 2/1980 | Scalzi | 308/4 A |
| 4,249,601 | 2/1981 | White | 166/208 |
| 4,311,194 | 1/1982 | White | 166/120 |
| 4,441,560 | 4/1984 | Baugh et al. | 166/382 |
| 4,489,781 | 12/1984 | Weeks | 166/208 |
| 4,497,368 | 2/1985 | Baugh | 166/208 |
| 4,498,534 | 2/1985 | Lindsey, Jr. | 166/208 |
| 4,523,641 | 6/1985 | Manderscheid | 166/208 |
| 4,580,631 | 4/1986 | Baugh | 166/208 |
| 4,603,743 | 8/1986 | Lindsey, Jr. | 166/382 |
| 4,624,311 | 11/1986 | Goad | 166/125 |
| 4,688,642 | 8/1987 | Baker | 166/382 |
| 4,766,956 | 8/1988 | Smith et al. | 166/182 |
| 4,834,185 | 5/1989 | Braddick | 166/382 |
| 4,848,462 | 7/1989 | Allwin | 166/212 X |

*Primary Examiner*—Hoang C. Dang

*Attorney, Agent, or Firm*—Edgar A. Zarins; Malcolm L. Sutherland

[57] ABSTRACT

A multiple cone, multiple bearing liner hanger for hanging a well liner for extension of the casing liner. The multiple slip cone and multiple bearing arrangement provides uniform, positive distribution of liner weight thereby facilitating hanging of heavier liner strings. The multiple bearings ensure proper rotation of the liner during cementation. The multiple cone, multiple bearing liner hanger includes an upper slip assembly with an associated bearing and a lower slip assembly with an associated bearing. The hanger is hydraulically set by first setting the upper slips and thereafter setting the lower slips. A series of shear pins ensure proper setting of the hanger to distribute the hang weight evenly over the slip cones and bearings.

14 Claims, 4 Drawing Sheets

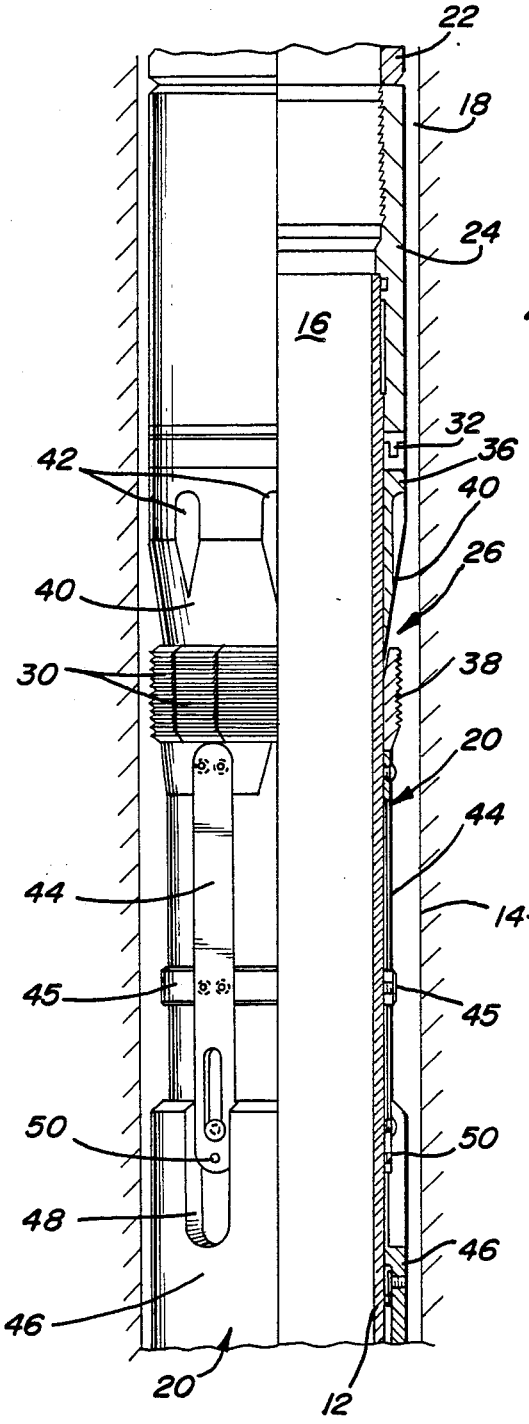
Fig-1
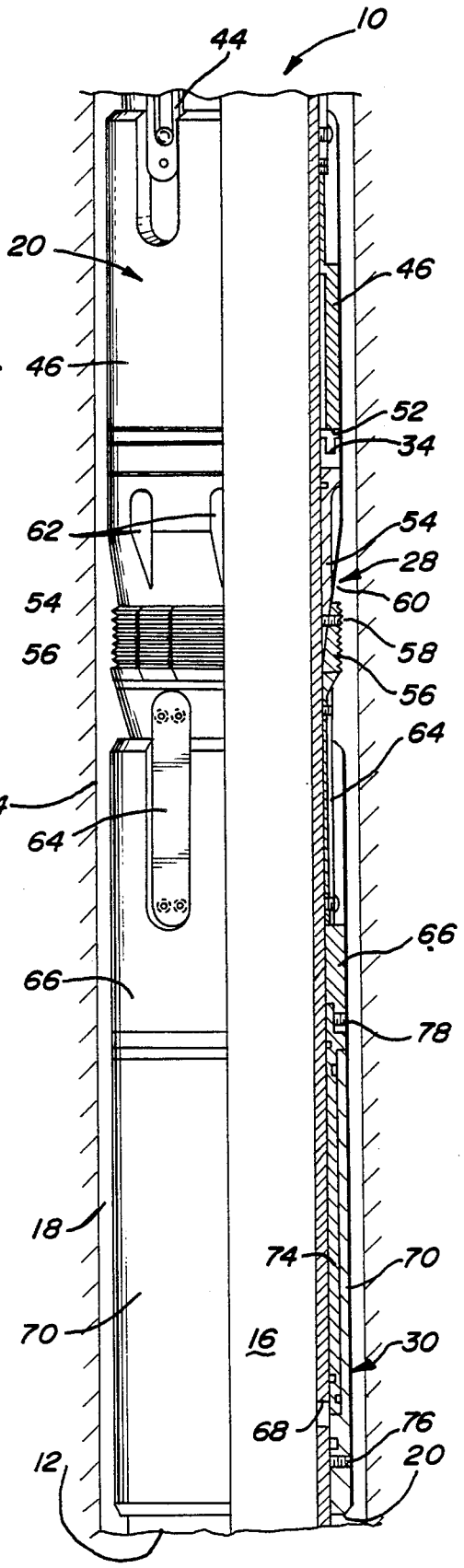

ROTATABLE LINER HANGER WITH MULTIPLE BEARINGS AND CONES

BACKGROUND OF THE INVENTION

I. Field of the Invention

This invention relates to rotatable liner hangers for setting successive sections of casing liner within a well bore and, in particular, to a liner hanger which incorporates double slip cones and double bearings for improved weight distribution of the liner.

II. Description of the Prior Art

Liner hangers have been used for many years to attach an inner string of well pipe or casing liner to the lower end of a larger diameter well pipe or casing liner already set within a well bore. After hanging the liner, the liner will usually be cemented within the well bore by circulating a cement slurry through a setting string and the interior of the liner and upwardly about the exterior of the liner. Typical liner hangers include at least one set of slips with slip elements which wedge on a slip cone to grip the interior surface of the outer casing. The slip elements are arranged to be expanded into gripping engagement with the interior of the larger casing by the underlying slip cone. The slip cone travels beneath the slip elements as a result of mechanical or hydraulic actuation of the tool. In many applications, the casing liners are long and heavy requiring additional slip area to assure effective attachment of the liner. Such attachment can be carried out by large slip assemblies or a plurality of spaced apart slip assemblies.

Because of the nature of the slurry used to cement the casing liners in place, it has been found that the rotation of the liner facilitates proper cementation. As a result, rotatable liner hangers were developed to ensure the flow of cement about the casing liner. Such rotatable liner hangers may utilize a rotatable bearing assembly in conjunction with the slip assembly. The bearing allows rotation of the liner independently of the set hanger during cementation. However, due to the increased length of some liners and a desire for additional fluid by-pass around the liner hanger multiple slip and cone arrangements have been used. It has been found that with some multiple cone rotatable liner hangers, a disproportionate load was being placed on the upper slip assembly and its associated bearing. This resulted in increased wear and failure of the rotatable liner hanger.

Liner hangers have been developed which comprise individual hanger units which can be connected in series to form a multiple bearing or a multiple cone liner hanger. However, because individual units must be manufactured and stocked, such a system is prohibitively expensive. Moreover, since the units operate independent of each other the load may not be evenly distributed between the individual liner hanger units. The separate units are also, at times, difficult to set with varying densities of cement slurry and mud displacement since multiple shear pins must be accurately and sequentially sheared to set the slips.

SUMMARY OF THE PRESENT INVENTION

The present invention overcomes the disadvantages of the prior known liner hangers by providing a bearing for rotation of the hanger and liner with each of the slip cones facilitating automatic and even weight distribution across the slip assemblies.

The rotatable liner hanger of the present invention includes a pair of longitudinally spaced slip assemblies mounted to the tubular mandrel of the hanger. The tubular mandrel allows fluids to be pumped therethrough including hydraulic fluid initially to set the liner hanger and thereafter cementing mud to secure the casing liner. Each slip assembly includes a slip cone and a plurality of contiguous or circumferentially spaced slip elements. The slip elements are forced outwardly into contact with the positioned casing liner as they travel over the slip cone. Circumferentially spaced slip elements facilitate the circulation of cement slurry past and around the liner hanger to secure the liner. Associated with each slip assembly is a bearing to facilitate rotation of the liner hanger during cementing. In a preferred embodiment the bearing is mounted to the mandrel just above the slip cone of the associated slip assembly. As a result, the weight of the liner is evenly distributed among the slip assemblies preventing a single slip assembly, usually the upper slip, from carrying a majority of the load. Additionally, the bearings allow rotation of the liner and hanger during cementing relative to the set and fixed slip assemblies. The multiple bearings increases the capacity which can be hung and rotated.

The liner hanger of the present invention is hydraulically set by pumping fluid through the hanger to operate a piston and cylinder connected to the slip assemblies. Shear pins are positioned such that the upper slip assembly is set against the casing first followed by setting of the lower slip assembly. This sequence ensures an even load on the slip assemblies and the associated bearings. Once the hanger is set, the liner and hanger may be cemented into position during which the liner can be rotated.

Other objects, features, and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which:

FIG. 1 is a partial cross-sectional perspective of the liner hanger, embodying the present invention run into the casing;

DETAILED DESCRIPTION OF A PREFERRED EMBODIMENT OF THE PRESENT INVENTION

Figure 2:
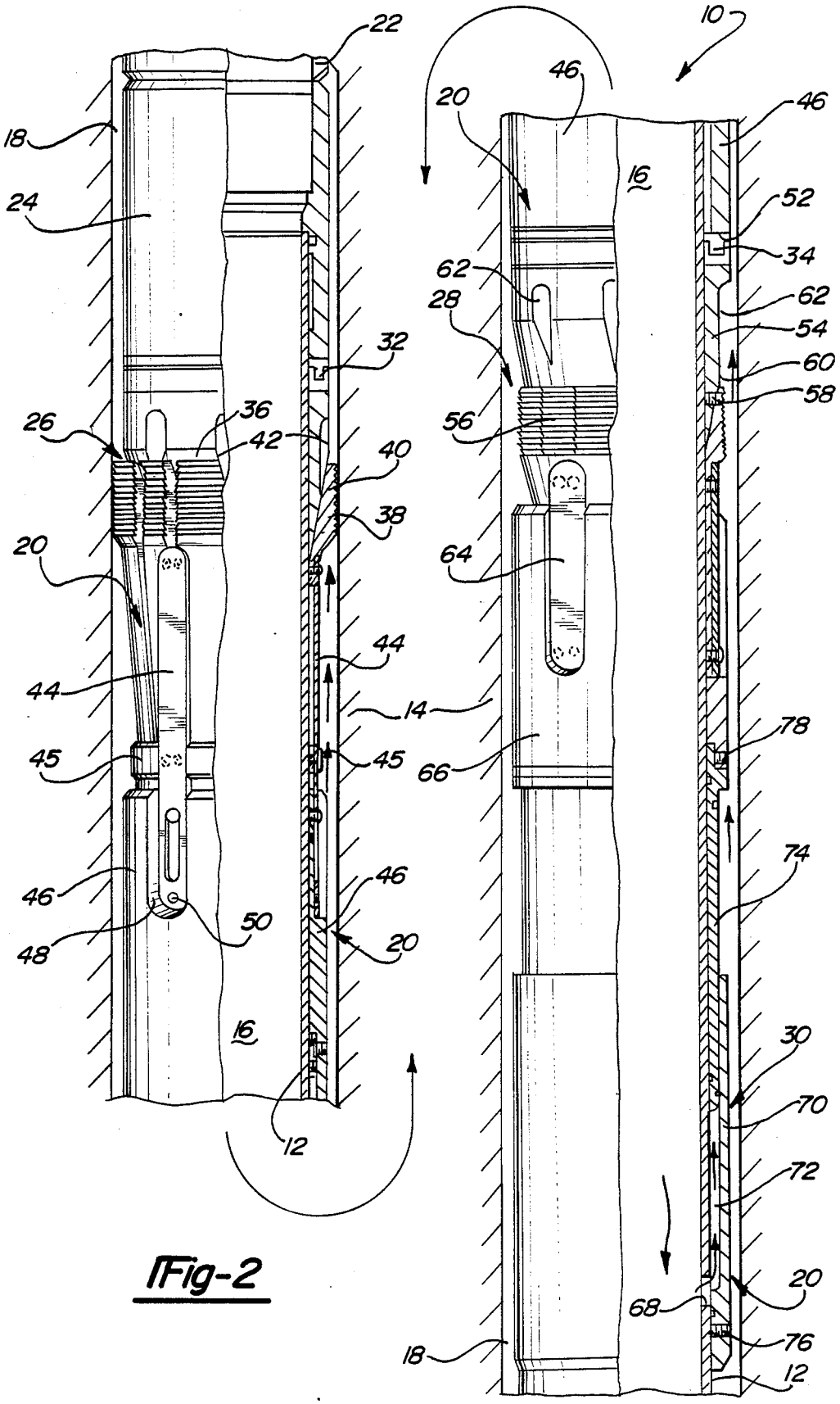
FIG. 2 is a partial cross-sectional perspective of the liner hanger with the upper slip assembly engaging the casing.
Figure 3:
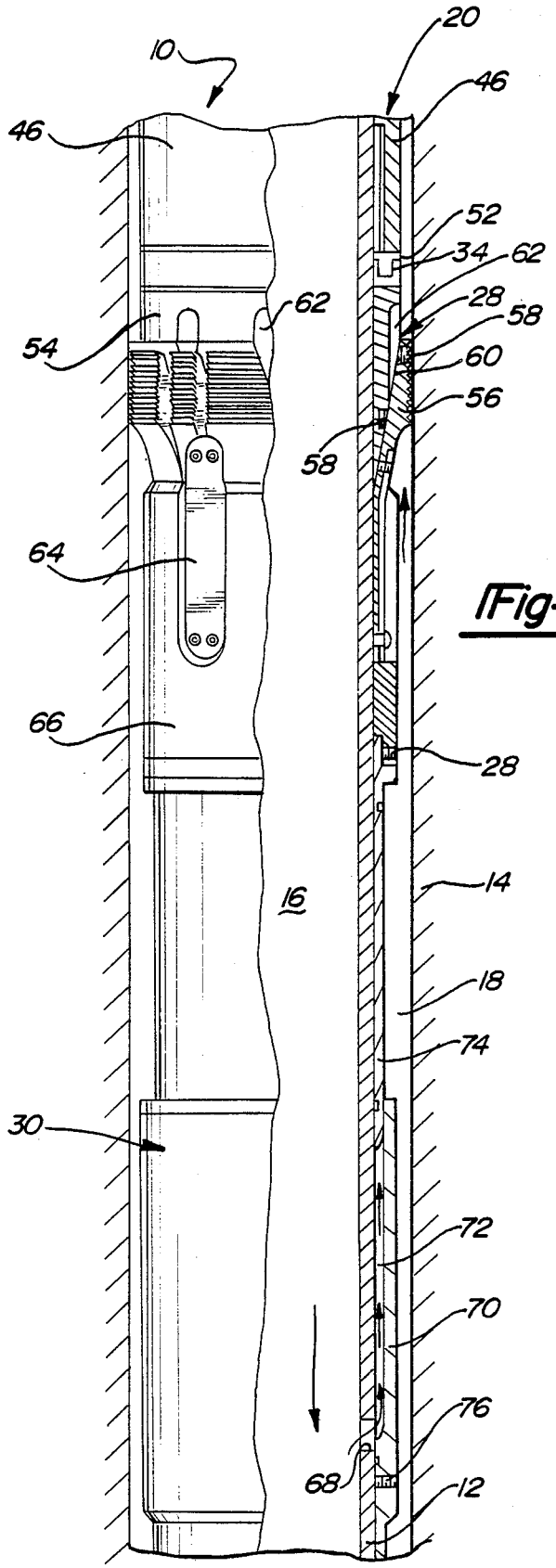
FIG. 3 is a partial cross-sectional perspective of the lower slip assembly in engagement with the casing.

Shown in FIGS. 1 through 3 is the rotatable liner hanger and liner assembly 10 embodying a preferred configuration of the present invention. The assembly 10 is utilized to run and set a new section of casing liner 12 within a well bore which may be a previously set casing section 14. Additional sections of liner 12 may be run into the well bore to extend the cased well bore with each liner extension 12 being connected to the lower end of the previously set casing section 14. Once a section of casing has been set it is normally cemented into position by pumping cement through the central passageway 16 to the bottom of the well bore and upwardly around the outside thereof to fill the outer annulus 18 securing the casing within the well bore. However, prior to cementation, the new casing section 12 must be set or "hung" from the previously secured liner section 14 using the liner hanger 20 of the present invention. The liner hanger and liner assembly 10 are run into the well bore using a releasably connected running string 22 to position the hanger 20 and liner 12 at the lower end of the outer casing liner 14. The running string 22 is preferably threadably connected to an end sub 24 attached to the upper end of the liner 12. Accordingly, the new section of casing liner 12 can be positioned and set within the well bore as will be subsequently described.

The liner hanger 20 of the present invention is mounted to the outer annular surface of the liner 12 and generally includes an upper slip assembly 26, a lower slip assembly 28 and a mechanism for setting the slips 30. In order to facilitate rotation of the liner 12 relative to the hanger 20 and the outer casing 14, each of the slip assemblies 26 and 28 is associated with a bearing assembly specifically an upper bearing member 32 associated with the upper slip assembly 26 and a lower bearing member 34 associated with the lower slip assembly 28. By supplying a bearing with each slip assembly, the of the liner 12 will be evenly distributed to both slip assemblies to ensure secure setting of the hanger 20 and smooth trouble-free rotation of the liner 12.

The upper slip assembly 26 includes an annular slip cone 36 mounted to the liner 12 and a plurality of slip elements 38 which are movable relative to the slip cone 36 to set the upper slip assembly 26. As the slip elements 38 move along the sloped surface 40 of the slip cone 36 the elements 38 will expand outwardly into engagement with the casing 14 as shown in FIG. 2. As the slip elements 38 expand outwardly they will separate to form gaps substantially aligned with notches 42 formed in the slip cone 36 creating a series of fluid passageways to bypass the upper slip assembly 26. These fluid passageways facilitate circulation of the cement around the upper slip assembly 26 to ensure proper setting of the liner 12. In a preferred embodiment, the annular bearing 32 is positioned between the end sub 24 of the liner 12 and the slip cone 36 of the upper slip assembly 26. As a result, the end sub 24 and liner 12 is free to rotate relative to the upper slip assembly 32 as will be subsequently described.

The slip elements 38 are attached to slip holders 44 which in turn are slidably connected to a spacer sleeve 46. The slip holders 44 are received within corresponding slots 48 formed in the spacer sleeve 46 and detachably secured thereto by shear screws 50. The screws 50 are designed to shear under a predetermined force once the upper slip assembly 26 has been set as will be described herein. The slip holders 44 and the spacer sleeve 46 are mounted to the exterior surface of the liner 12 such that the liner 12 will be free to rotate relative thereto since the holders 44 and sleeve 46 will be held stationary by the set slip elements 38. The sleeve 46 includes an abutment end 52 which cooperates with the lower slip assembly 28 and bearing 34.

Figure 4:
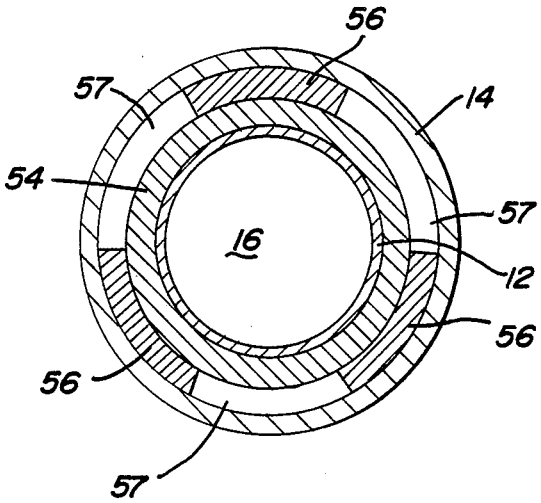
FIG. 4 is a cross-sectional view of the slip assembly in engagement with the casing taken along lines 4—4 of FIG. 3.

The lower slip assembly 28 similarly includes a slip cone 54 and a plurality of selectively expandable slip elements 56. The slip elements 56 are detachably connected to the slip cone 54 by shear screws 58 which prevent the slip elements 56 from travelling up the slope surface 60 of the slip cone 54 and setting against the casing 14 until sufficient force is applied to shear the screws 58. The shear screws 58 allow the upper slip assembly 26 to be set prior to setting of the lower slip assembly 28 ensuring uniform weight distribution. As the slip elements 56 expand outwardly into engagement with the casing 14 (FIG. 3), the elements 56 will separate forming gaps substantially aligned with notches 62 formed in the slip cone 54 creating a series of fluid bypass passageways. A cross-sectional perspective view of the set slip assembly with the slip elements 56 separated in spaced apart relation forming the bypass passageways 57 is shown in FIG. 4. These passageways facilitate circulation of the cement past and around the lower slip assembly 28. To allow independent rotation of the lower and upper slip assemblies, the lower bearing 34 is disposed between the upper end of the slip cone 54 and the end 52 of the sleeve forming a part of the upper slip assembly 26. Accordingly, once the upper slip assembly 26 has become set within the casing 14 the lower slip assembly 28 will not be fixed against rotation. Furthermore, upon setting both slips, the weight of the liner 12 will be distributed over both bearings 32 and 34 allowing greater sections of casing to be hung and rotated. The slip elements 56 are connected to slip holders 64 which are connected to a lower spacer sleeve 66. The sleeve 66 and holders 64 are slidably mounted to the outer surface of the liner 12.

In order to set the slips through longitudinal movement relative to the liner 12, the sleeve 66 is connected to the setting mechanism 30. In a preferred embodiment, the mechanism 30 is responsive to fluid pressure within the liner 12 which is communicated thereto through at least one port 68 formed in the liner 12. The setting mechanism 30 includes an outer sleeve 70 or cylinder which forms an annulus 72 with the liner 12. Received within the annulus 72 is an inner sleeve 74 or piston. The lower end of the annulus 72 communicates with the port 68 such that an increase in fluid pressure within the liner 12 will cause the piston 74 to longitudinally slide within the cylinder 72. The outer sleeve 70 is connected to the liner 12 against relative movement by set screw 76. The piston or inner sleeve 74 is connected to the spacer sleeve 66 of the lower slip assembly 28 by set screws 78 wherein as piston 74 is forced to move longitudinally as a result of fluid pressure within the cylinder 72 the slip assemblies will also be moved to set the hanger 20.

Referring now to FIGS. 1 through 3, which show the liner hanger 20 at various stages of being set, the liner and liner hanger assembly 10 is run into the well bore using string 22. Once the hanger 20 is positioned near the lower end of the outer casing 14, fluid pressure within the central passageway 16 is increased to actuate the setting mechanism 30. The increased fluid pressure causes the piston sleeve 74 to move upwardly relative to the liner 12 and cylinder sleeve 70. The longitudinal movement of the sleeve 74 in turn will cause the lower slip assembly 28, the lower bearing 34, the spacer sleeve 46 and the slips 38 of the upper slip assembly 26 to also move longitudinally relative to the liner 12. Since the slips 56 of the lower slip assembly 28 are connected to the slip cone 54, the longitudinal movement will be imparted to the cone 54 preventing the lower slip assembly 28 from setting. As the slip elements 38 of the upper slip assembly 26 travel along the sloped surface 40 of the cone 36, which remains stationary, the slip elements 38 will expand outwardly into engagement with the casing 14 as shown in FIG. 2. Once the upper slip assembly 26 is set continued upward pressure will cause screws 50 to shear moving spacer sleeve 46 relative to the slip holders 44 until the sleeve 46 engages retaining ring 45. Further pressure will cause screws 58 to shear releasing the slip elements 56 from the slip cone 54 allowing them to move along sloped surface 60 into expansion against the casing 14 as shown in FIG. 3. With both slip assemblies set, the weight of the liner 12 can be released thereby preventing the slips from disengaging. Moreover, as the slip assemblies are set and particularly once the weight of the liner 12 is released, the weight of the liner 12 will be distributed over both bearings 32 and 34 thereby increasing the bearing capacity of the hanger 20. Similarly, the hang weight of the liner 12 will be evenly distributed over both slip assemblies. Thus, the liner hanger 20 of the present invention will allow larger sections of liner 12 to be hung and set.

Figure 5:
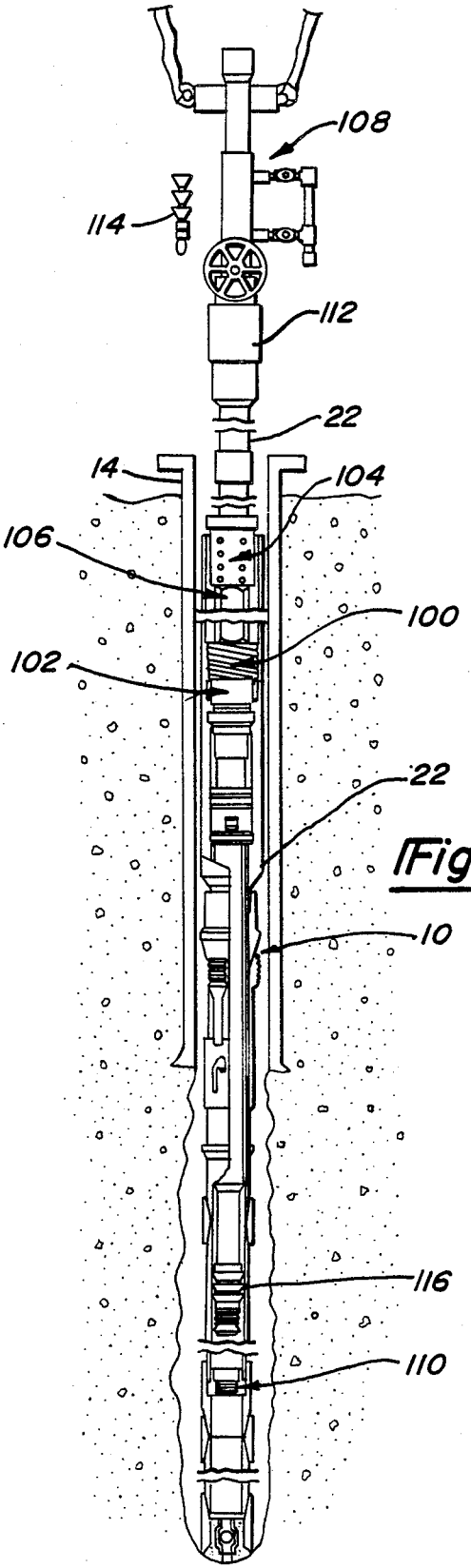
FIG. 5 is a perspective view of the running equipment used to run and set the liner hanger of the present invention within the well bore.

The liner hanger assembly 10 of the present invention is run into the cased 14 and open bore hole using the running equipment shown generally in FIG. 5. The liner hanger 20 is run on drill pipe and attached by a running seat 100 which attaches the hanger 20 to a setting tool 102. A portion of the liner 12 extends above the running seat 100 and includes a debris barrier 104 which prevents debris from falling into the tie-back receptacle 106. The drill pipe 22 extends to the surface where a dropping head manifold 108 is installed. When the liner 12 is run to the desired depth, drilling mud is circulated down the drill pipe 22 and back up the annulus surrounding the running equipment to clean up the well. To set the hydraulic liner hanger 20 a ball is dropped from the dropping head 108 and pumped to a seat 110 just below the liner hanger 20. Fluid pressure is applied which activates the setting mechanism 30 in the hanger 20 to set the slips 26 and 28. Liner weight is slacked off so that the slip elements will bite into the casing 14 to suspend the liner 12. When additional fluid pressure is applied, the ball seat 110 shears out to re-establish circulation. Once the hanger assembly 10 is set and the setting tool is released by clockwise rotation, the new liner 12 can be cemented within the hole. During cementation, the liner 12 may be rotated using a rotary table 112 to obtain an improved cement job.

Once the hanger 20 is set, the liner and liner hanger assembly 10 may be cemented into place. The cement is typically pumped through the central passageway 16 to the bottom end of the liner 12 at which point the cement will flow upwardly around the outside of the liner 12. The gaps between the slip elements allow the cement to completely fill the outside of liner hanger 20 and the liner 12 for securement thereof. To facilitate thorough cementation of the liner and hanger, the liner 12 is rotated using the string 22 during cementation. The liner 12 can be rotated relative to the hanger 20 because of the double bearings 32 and 34.

When sufficient cement slurry has been pumped through the passageway 16, a drill pipe plug 114 is released from the dropping head 108 and pumped downhole until it reaches the liner wiper plug 116. Increased pressure will shear the liner wiper plug 116 causing it to seat within the landing collar 110. The drill pipe plug 114 and the liner wiper plug 116 act as a back pressure valve to prevent the cement slurry from flowing back inside the liner 12. Upon completion of the cementing process, the drill pipe 22 and the setting assembly are pulled from the hole.

The foregoing detailed description has been given for clearness of understanding only and no unnecessary limitations should be understood therefrom as some modifications will be obvious to those skilled in the art without departing from the scope and spirit of the appended claims.

I claim:

1. A rotatable liner hanger and casing liner assembly for securing the casing liner within a well bore comprising:

an upper slip assembly mounted to the casing liner, said upper slip assembly including a plurality of slip elements and a slip cone;

an upper bearing assembly mounted to the casing liner adjacent said upper slip assembly for rotation of the casing liner relative to said upper slip assembly;

a lower slip assembly mounted to the casing liner, said lower slip assembly including a plurality of slip elements and a slip cone;

a lower bearing assembly axially slidably mounted to the casing liner adjacent said lower slip assembly for rotation of said lower slip assembly relative to said upper slip assembly and rotation of the casing liner relative to said lower slip assembly; and fluid pressure responsive means mounted to the casing liner for effecting longitudinal movement of said lower slip assembly, said lower bearing assembly and said slip elements of said upper slip assembly to set said upper slip assembly and said slip elements of said lower slip assembly to secure the casing liner within the well bore.

2. The assembly as defined in claim 1 wherein said slip cone of said upper slip assembly is positionally captured to prevent longitudinal movement thereof along the casing liner.

3. The assembly as defined in claim 2 wherein the casing liner includes an end sub, said upper bearing assembly disposed between said end sub of the casing liner and said slip cone of said upper slip assembly to facilitate rotation of the liner relative to said upper slip assembly.

4. The assembly as defined in claim 3 wherein said upper slip assembly includes a spacer sleeve connected to said slip elements of said upper slip assembly, said sleeve slidably mounted to the casing liner for longitudinal movement relative thereto.

5. The assembly as defined in claim 4 wherein said lower bearing assembly is disposed between said spacer sleeve and said slip cone of said lower slip assembly to facilitate rotation of said lower slip assembly relative to said upper slip assembly and the casing liner relative to said lower slip assembly.

6. The assembly as defined in claim 5 wherein said fluid pressure responsive means comprises an outer sleeve mounted to the casing liner and having an annulus therebetween to form a cylinder and a piston member slidably disposed within said cylinder, said cylinder communicating with the interior of the casing liner whereby an increase of fluid pressure within said cylinder will cause said piston member to move longitudinally relative to the casing liner and cylinder to set said upper slip assembly and said lower slip assembly to secure the casing liner within the well bore.

7. The assembly as defined in claim 6 wherein said slip elements of said lower slip assembly are detachably connected to said slip cone such that said upper slip assembly sets prior to said lower slip assembly.

8. A rotatable liner hanger and liner assembly for securing the liner within a well bore, the liner including an end sub having an abutment surface, said assembly comprising:

an upper slip assembly mounted to the casing liner, said upper slip assembly including a slip cone, a plurality of slip elements longitudinally movable relative to said slip cone to set said upper slip assembly, and a spacer sleeve connected to said plurality of slip elements;

an upper bearing assembly mounted to the liner between the abutment surface of the end sub and said slip cone of said upper slip assembly for rotation of the liner relative to said upper slip assembly;

a lower slip assembly axially slidably mounted to the casing liner, said lower slip assembly including a slip cone and a plurality of slip elements longitudinally movable relative to said slip cone to set said lower slip assembly;

a lower bearing assembly mounted to the liner between said spacer sleeve of said upper slip assembly and said slip cone of said lower slip assembly for rotation of said lower slip assembly relative to said upper slip assembly and the liner relative to said lower slip assembly; and means for effecting longitudinal movement of said lower slip assembly, said lower bearing assembly, and said slip elements of said upper slip assembly relative to the liner to set said upper and lower slip assemblies to secure the liner within the well bore.

9. The assembly as defined in claim 8 wherein said slip elements of said lower slip assembly are detachably connected to said lower slip cone such that said upper slip assembly is set prior to setting of said lower slip assembly, said slip elements detaching from said lower slip cone once said upper slip assembly has been set.

10. The assembly as defined in claim 8 wherein said means for effecting longitudinal movement is responsive to fluid pressure within the liner.

11. A liner hanger setting assembly for lowering with a casing liner into a well bore to secure the liner therein and facilitate rotation of the liner relative to the liner hanger, said liner hanger setting assembly comprising:

an upper slip assembly having an associated bearing member to allow rotation of the liner relative to said upper slip assembly;

a lower slip assembly having an associated bearing member axially slidably mounted to the liner to allow rotation of the liner relative to said lower slip assembly and rotation of said lower slip assembly relative to said upper slip assembly;

means for preventing said lower slip assembly from setting until said upper slip assembly has set; and fluid pressure responsive means for effecting longitudinal movement of said lower slip assembly and said upper slip assembly to sequentially set said lower and upper slip assemblies to secure the casing liner in the well bore such that the weight of the casing liner is evenly distributed across said slip assemblies and said associated bearing members, the liner being rotatable relative to said upper and lower slip assemblies to facilitate cementation of the liner within the well bore.

12. The assembly as defined in claim 11 wherein said lower slip assembly and said upper slip assembly include a slip cone and a plurality of slip elements, said slip elements expandable to set the hanger as said elements travel across said slip cone.

13. The assembly as define in claim 12 wherein said bearing member associated with said upper and lower slip assemblies is disposed adjacent said slip cones thereof longitudinally uphole of said slip assemblies.

14. The assembly as defined in claim 11 wherein said fluid pressure responsive means comprises a hydraulic piston and cylinder, said cylinder communicating with the interior of the casing liner whereby an increase in fluid pressure causes said piston to travel within said cylinder moving said slip elements across their respective slip cones to set said slip assemblies and secure the liner within the well bore.

* * * * *